United States Patent [19]

Speich

[11] Patent Number: 4,628,711

[45] Date of Patent: Dec. 16, 1986

[54] PROCESS FOR MANUFACTURING A PATTERNED WARP-KNITTED MATERIAL AND A WARP KNITTING MACHINE FOR ITS USE

[75] Inventor: Francisco Speich, Gipf-Oberfrick, Switzerland

[73] Assignee: Textilma AG, Hergiswil, Switzerland

[21] Appl. No.: 822,421

[22] PCT Filed: Feb. 6, 1985

[86] PCT No.: PCT/CH85/00019

§ 371 Date: Dec. 19, 1985

§ 102(e) Date: Dec. 19, 1985

[87] PCT Pub. No.: WO85/04911

PCT Pub. Date: Nov. 7, 1985

[30] Foreign Application Priority Data

Apr. 26, 1984 [CH] Switzerland ..... 2046/84

[51] Int. Cl.[4] ..... D04B 23/00

[52] U.S. Cl. ..... 66/204

[58] Field of Search ..... 66/203, 207, 204

[56] References Cited

U.S. PATENT DOCUMENTS 4,331,009 5/1982 Kohl ..... 66/203

4,358,939 11/1982 Kohl ..... 66/203

4,417,456 11/1983 Bergmann et al. ..... 66/214

FOREIGN PATENT DOCUMENTS 2027757 2/1980 United Kingdom ..... 66/203

*Primary Examiner*—Ronald Feldbaum

*Attorney, Agent, or Firm*—McCormick, Paulding & Huber

[57] ABSTRACT

In a warp knitting machine, warp stitch rows are formed from warp threads which are held together at least by a weft thread. Patterned threads are applied to the warp rows and are fed in a manner similar to the warp threads. For this purpose, a warp thread guide (18) and pattern thread guides (24) are positioned in front of the knitting needles and are moved over the knitting needles. At the sections of the knitting which are to receive a pattern, the pattern threads are applied on top of the warp threads resting in the needles and are knitted together. At the locations where no pattern is desired, controlled thread retainers prevent the insertion or threading of the pattern threads into the knitting needles and hence the knitting of the pattern threads in with the warp threads does not take place. At the pattern-free locations, the pattern threads are simply inserted into the warp stitch rows.

17 Claims, 15 Drawing Figures

Figure 1:
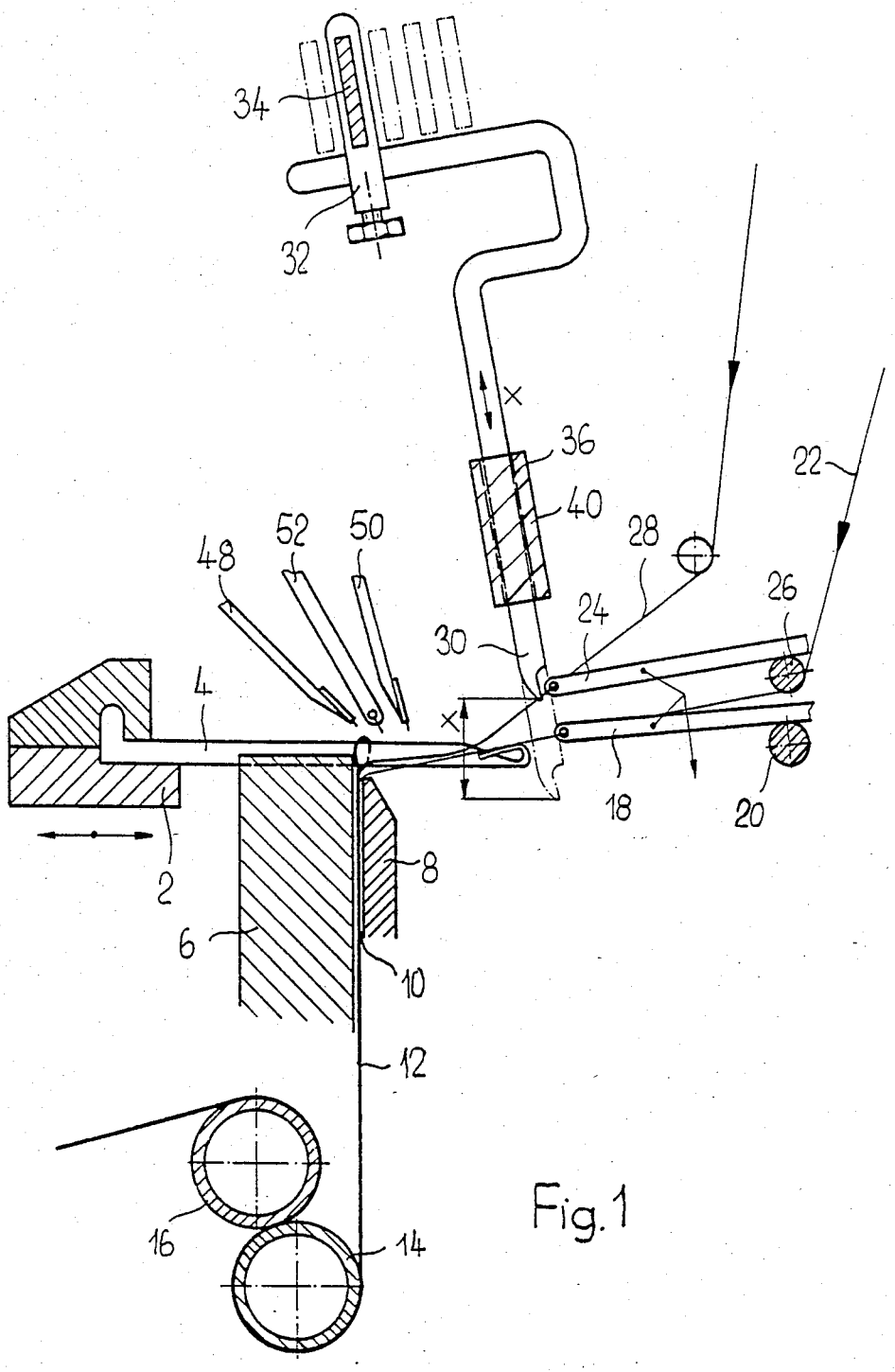

30a
30b 4a
4b
22
28
88
24
18
12
90

PROCESS FOR MANUFACTURING A PATTERNED WARP-KNITTED MATERIAL AND A WARP KNITTING MACHINE FOR ITS USE

The invention consists of a process for manufacturing a patterned warp knit material according to the preamble of claim 1 as well as a knitting machine for carrying out the method according to the preamble of claim 6.

U.S. Pat. No. 3,999,407 describes a process for manufacturing a patterned warp knit material of the foregoing type. In that process, the pattern threads actually are only inserted into one warp stitch row. This has the disadvantage that such a pattern is constrained to be very narrow along the warp stitch row, and a relatively large portion of the non-pattern base of the knitting is visible between adjacent patterned rows. Accordingly, the pattern is diluted. Besides, such knitting has the disadvantage that when damaged, the stitches readily come unraveled. Furthermore, this patterned material has the disadvantage that the pattern from one row of stitches to the next must always be the same for all stitches, that is, all warp stitch rows which contain pattern threads must be patterned or not patterned in the same manner in each stitch row. Accordingly, narrow constraints are placed on the patterning of the warp knitting.

It is accordingly an object of the present invention to provide a method and a knitting machine with which patterned knitting can be manufactured with pattern threads that more completely cover the knitted work, particularly between the patterned warp stitch rows and which above all has a minimal tendency to come unraveled when the stitching is damaged.

The asserted object is achieved according to the process described in the characterizing features of claim 1, and the knitting machine, such as a galloon crocheting machine is described in the characterizing features of claim 6.

Accordingly, a connection is established between two and in some instances three or more patterned warp stitch rows in which the pattern threads, in the case of a pattern, are inserted by means of at least two and in some instances three or more knitting needles. In this manner, an improved coverage of the base of the patterned knitted work takes place. By working pattern threads into at least two warp stitch rows, a further advantage is achieved in that the tendency of the knitting to unravel, that is, to loosen as a result of destruction of the stitches, is minimized. Accordingly, when the thread retainers are individually controlled, collectively or singly, a greater variation in the pattern can be produced. Since the pattern threads, like the warp threads, are fed and processed continuously, and the pattern is produced only by means of controllable thread retainers, an especially simple process and a correspondinlgly simple knitting machine, for example, the galloon crocheting machine, is produced and yields a correspondingly high performance.

Preferred embodiments of the process are described in dependent claims 2–5, and preferred embodiments of the knitting machine are described in dependent claims 7–17.

It is possible for the pattern threads for each process to be fed simultaneously by means of at least two knitting needles and to be processed with the warp threads. A procedure according to claim 2, however, is particularly advantageous, since on the one hand interweaving is facilitated, and on the other hand, the stitching integrity is improved.

The process itself can be accomplished with various knitting needles such as tongue needles or slide needles. In such cases the longitudinal dirrection of the warp thread and the pattern threads can be arbitrarily selected and changed. The process according to claim 3, however, is particularly advantageous as it permits a very high production speed.

The thread retainers can under certain circumstances be located above the driven knitting needles. An embodiment according to claim 4 is particularly advantageous, however, since there the thread retainer is separate from the knittling needles, like the thread guides for the warp threads and the pattern thread, and thereby is not obstructed by these components and the reversibility of its functions is not prevented.

To control the thread retainers, a wide variety of devices can be employed. An electronic pattern control device is particularly simple.

The pattern thread guides for each process can be guided simultaneously above at least two knitting needles, and a simultaneous interweaving occurs in at least two warp stitch rows. It is advantageous to employ a configuration according to claim 7 in which the interweaving takes place actually in only one warp stitch row whereby the warp stitch row can be changed from one knitting process to another.

The pattern thread guides can have any desired configuration, such as for example a tube thread guide. A configuration according to claim 8, however, is particularly advantageous.

A particularly preferred embodiment of the knitting machine is described in claim 9. One such embodiment according to claim 10 is particularly suitable for tongueless formed knitting needles.

A particularly reliable situation is made possible by the knitting machine according to claim 11. The positioning of the thread retainers can be selected at will; however, the embodiment according to claim 12 is especially favored. The thread retainers can be located directly in the region of the knitting needles and can be movable back and forth. An embodiment according to claim 13, however, is useful since here the individual components do not interfere with each other and in general the thread retainers can be designed to be very rugged. This embodiment in particular permits the thread retainers to be moved laterally if it is necessary to do so.

According to claim 15, the thread retainers can be connected with a pattern control device. In this manner, the thread retainers according to claim 14 can be located in groups on the lifting and lowering rods. However, the embodiment of claim 17 is especially advantageous since the latter guarantees the greatest variation in patterns in the knitted work.

Exemplary embodiments of the objects of the invention are described below with the aid of drawings which show:

FIG. 1—A knitting machine in schematic illustration, in a fragment and vertical cross section.

Figure 2:
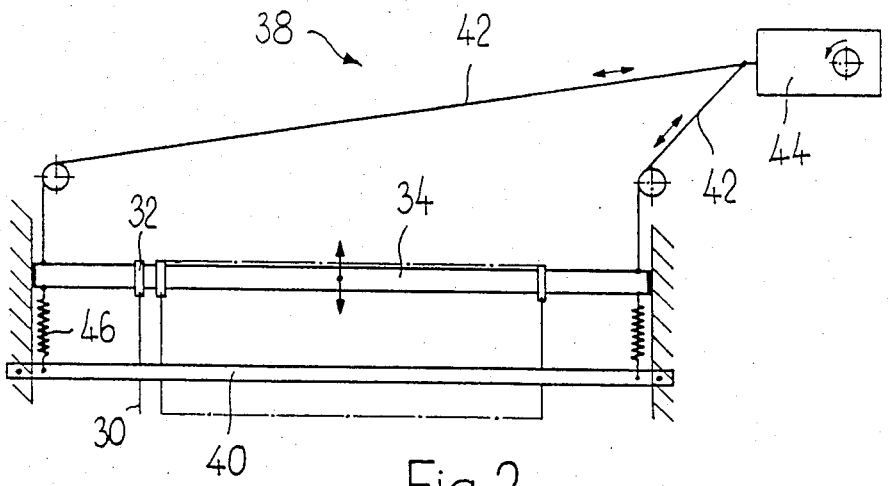

FIG. 2—A drive and control device for the thread retainers in a view corresponding to FIG. 1 rotated by 90 degrees.

Figure 3:
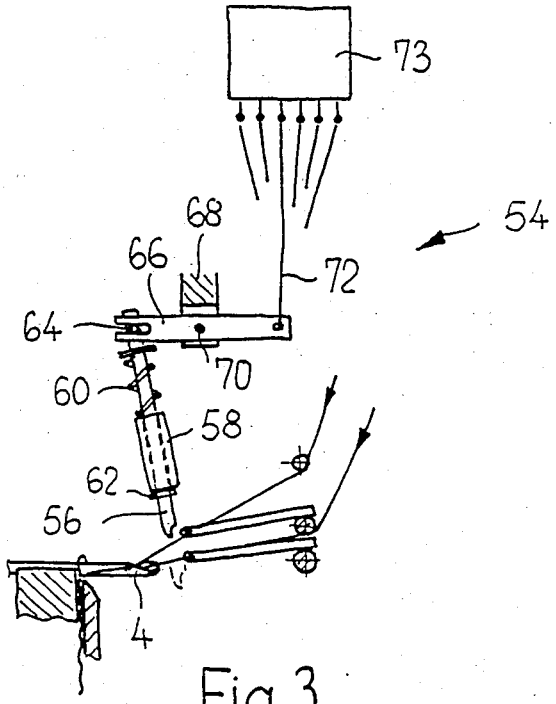

FIG. 3—A portion of an oscillatory drive for the thread retainer in the view according to FIG. 1.

Figure 4:
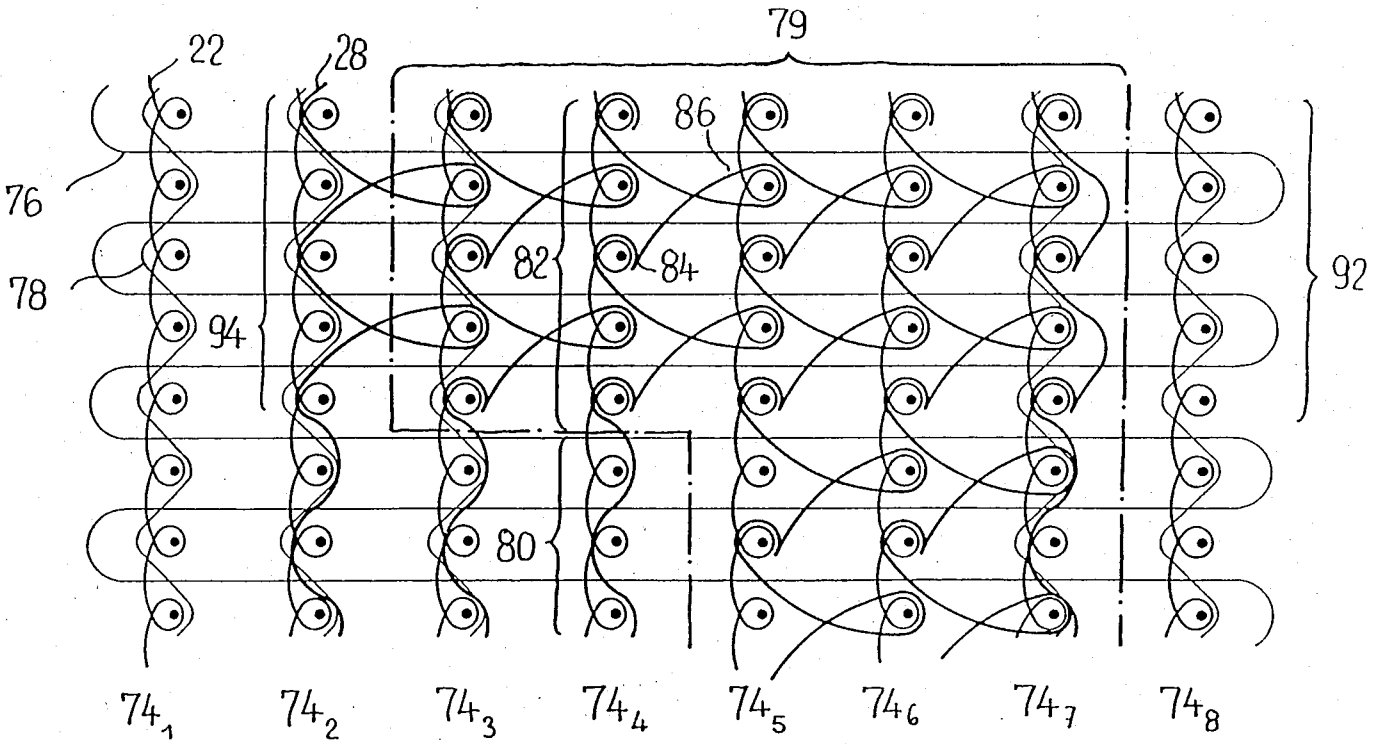

FIG. 4—A fragmentary section from a patterned knitted work.

FIGS. 5*a*–5*f*—Various operating phases during the insertion of a pattern thread into a knitting needle;

FIGS. 6*a*–6*e*—Various operating phases which prevent the insertion of a pattern thread into a knitting needle.

The knitting machine illustrated schematically in FIG. 1, for example, a galloon crocheting machine, consists of a needle bar 2 in which a series of knitting needles 4 are arranged in parallel relationship. The needle bar moves the needles 4 back and forth in the lengthwise direction. The needles 4 are guided in a cast comb 6. A guide plate 8 is movably connected to the comb 6 and forms a guide column 10 with the comb 6. By means of the column, the finished knitting 12 is guided to a takeout roll and is guided around the roll by means of a pressure roll.

Warp thread guides 18 are movably mounted in front of the knitting needles 4. The guides are formed as needles with eyes and are fixed to a knitting bar 20. By means of the knitting bar 20 the thread guides are driven firstly with back and forth movement in the direction of the knitting bar, as well as secondly with an oscillatory movement between an upper position above the knitting needle plane (FIG. 1) into a lower position below the knitting needle plane. The thread guide 18 accordingly can insert a warp thread 22 into the knitting needle 4 in a circular motion around the knitting needle 4. Pattern thread guides 24 are positioned above the warp thread guides 18 and likewise are formed as needles with eyes. The pattern thread guides 24 are fixed to a pattern thread bar 26, and perform an axial movement similar to the knitting bar 20 over at least two knitting needles and an rocking movement, so that the pattern thread guide 24 can be brought from an upper position above the plane of the knitting needles (FIG. 1) to a lower position below the plane of the knitting needles. Each pattern thread guide 24 serves to guide and insert a pattern thread 28 into a knitting needle 4.

Thread retainers 30 are positioned between the forwardmost position of the knitting needle 4 (FIG. 1) and the warp thread guides 18 and the pattern thread guides 24. These retainers are movable back and forth between an upper position illustrated in FIG. 1 above the knitting needle plane and a lower position illustrated in phantom. The thread retainers 30 are fixed by means of clamping members 32 to a guide rod 34. One such guide rod 34 is clearly illustrated in FIG. 1, and further guide rods are indicated in phantom. A plurality of thread retainers 30 can be positioned on each of the guide rods 34, and can be actually moved back and forth a distance X. In the uppermost position, it is possible for a thread retainer 30 to insert a pattern thread 28 into a knitting needle 4. In the lower position, the retainer 30 prevents the insertion of a pattern thread 28 into the knitting needle 4, as is explained in greater detail below. The thread retainers 30 are guided back and forth in a stationary guide 36.

A pattern control device 38 as shown in FIG. 2 serves to control the thread retainers 30. FIG. 2 further shows a guide rod 40 in which the guides 36 for the thread retainers 30 are positioned. The guide bar 34 is held by a drawing device 42 and is connected with a control box 44 which pulls or releases the drawing device 42 in accordance with a predetermined program so that the guide bar 34 can be moved back and forth in opposition to the forces of the suspension springs 46.

A forward weft thread guide 48 and a rear weft thread guide 50 are further shown in FIG. 1 and between the two guides a further thread guide 52 is located for insertion of elastic threads.

A further pattern control device 54 is illustrated in FIG. 3, and in this device the thread retainers 56 are mounted in a guide rod 58 for axial movement. A suspension spring 60 holds the thread retainer 56 against a stop 52 in the illustrated upper position. A rocker arm 66 is connected to the thread retainer by means of a bolt 64 and is mounted for oscillatory movement about an axis 70 in the machine frame 68. On the end opposite the thread retainers 56, a harness string 72 is secured, and the string is connected into a programmable control device 73, for example, a jacquard device. Each individual thread retainer 56 is individually controlled in this manner so that maximum pattern options are available.

FIG. 4 illustrates a fragment of a knitted work which may be manufactured with a knitting machine of the type shown in FIGS. 1–3. The knitted work consists of individual warp stitch rows $74_1$–$74_8$ which are actually formed by a warp thread 22. The individual warp stitch rows are connected with one another in each stitch row by means of weft threads 76 which are inserted into the stitches of the warp stitch rows. The warp stitch rows can additionally contain an interwoven elastic thread 78 as is shown for the warp stitch rows $74_1$, $74_2$, $74_3$, $74_7$, and $74_8$. The knitted work contains a patterned region 79 and unpatterned regions. The pattern threads 28 serve to define the pattern, and where they should not be visible, they are inserted into the stitches of the warp stitch rows and thereby will be covered by the warp thread stitches, as for example is shown in FIG. 4 for the nonpatterned section 80 of the warp stitch rows $74_4$.

In the patterned section 82 of the warp stitch rows $74_4$ shown in FIG. 4, the individual pattern threads 28 are guided back and forth between the two warp stitch rows, for example, $74_4$ and $74_5$, and are actually interwoven in the warp stitch rows. In this manner, the individual stitches of the pattern threads 28 lie on top of the stitches of the warp threads 22 and appear with the threads as a pattern on the upper surface of the knitted work. The pattern thread 28 forms a stitch 84 on the warp stitch row $74_4$, and a stitch 86 on the warp stitch row $74_5$. With the knitted work illustrated in FIG. 4, the inserted threads are actually fed continuously in the same direction over the knitting needle 4 which is particularly necessary with the manufacture of knitting by means of tongueless knitting needles, such as crocheting needles in particular.

The manufacture of knitted works is described further below with the aid of FIGS. 4 as well as 5*a* to 5*f* or correspondingly 6*a* to 6*e*. Accordingly, 5*a* to 5*f* show the knitting of a pattern thread which is intended to be visible at the front side of the knitted work, and FIGS. 6*a* to 6*e* show the insertions of a pattern thread when it is not supposed to be visible in the knitting.

Figures 5A, 5B, 5C:
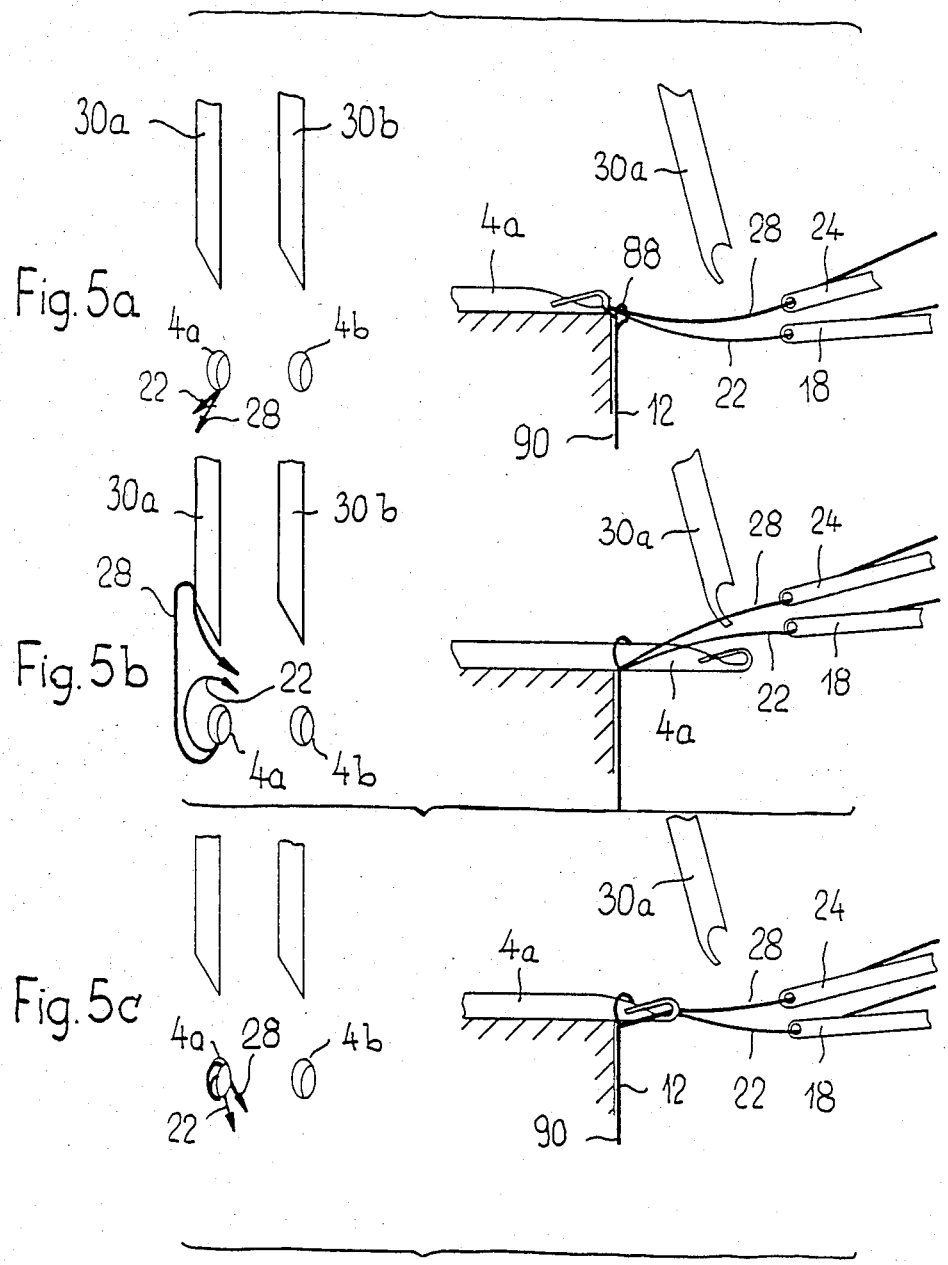
Figure 5D:
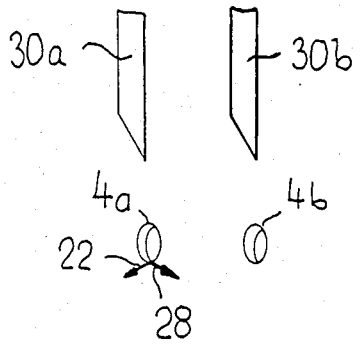

FIG. 5*a* shows the work stage in which the knitting needle 4*a* is retracted and a stitch 88 has been taken up. The thread retainers 30*a* and 30*b* are in an upper position, and the warp thread guide 18 and the pattern thread guide 24 are in the lower position below the plane of the knitting needles. In the next work stage, the knitting needle 4*a* is pushed forward and the warp thread guide 18 and the pattern thread guide 24 moves into the upper position above the plane of the knitting needles as well as over the knitting needle 4*a* and then at the other side (on the right side in the figures), again into the lowermost position, as is apparent from the FIGS. 5*b* and 5*c*. The thread retainer 30, assuming the upper position, does not prevent the overlaying of the pattern thread 28, so that indeed the warp thread 22 like the pattern thread 28 is inserted into the knitting needle 4*a* whereby the pattern thread 28 lies on top of the warp thread 22. The warp thread and the pattern thread 28 pass through the stitch 88, that is, they are knitted into the knitting work. The pattern thread 28 is then visible at the front side 90 of the knitted work 12.

Figure 5E:
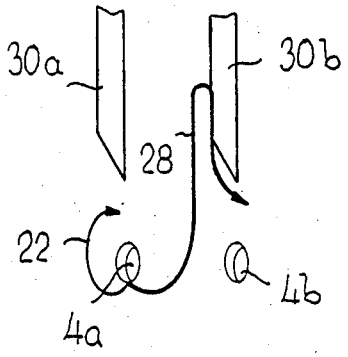
Figure 5F:
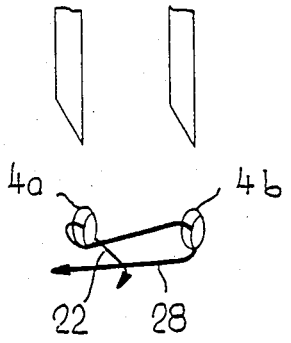

In the next stage, the warp thread guide 18 sweeps around the knitting needle 4*a* while the pattern thread guide 24 is displaced to the right of the knitting needle 4*b* anc circles around this needle as can be taken from FIGS. 5*e* and 5*f*. The pattern thread 28 is now inserted into the knitting needle 4*b* in which the warp thread 22 (not illustrated) of the neighboring warp loop row also lies. During the withdrawal of the knitting needle and the taking up of the stitches, the pattern thread guide 24 is again moved back to the lower position at the first knitting needle 4*a* and a new work cycle can begin.

Figure 6A:
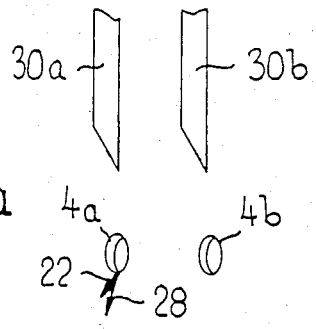
Figure 6B:
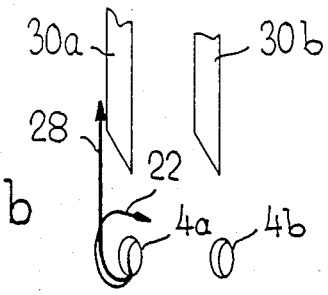

FIGS. 6*a* to 6*e* show how the insertion of a pattern thread 28 in the knitting needles 4*a* and 4*b* is prevented. FIGS. 6*a* and 6*b* correspond primarily to the work stages shown in FIGS. 5*a* and 5*b*. As soon as the warp thread guide 18 and the pattern thread guide 24 assume the upper position illustrated in FIG. 5*b*, the thread retainer 30*a* is lowered and by this means prevents the insertion of the pattern thread 28 into the knitting needle when the warp loop thread guide 18 and the pattern thread guide 24 lie next to the knitting needle 4*a* and are brought into the lowermost position as is visible in FIG. 6*c*.

Figure 6C:
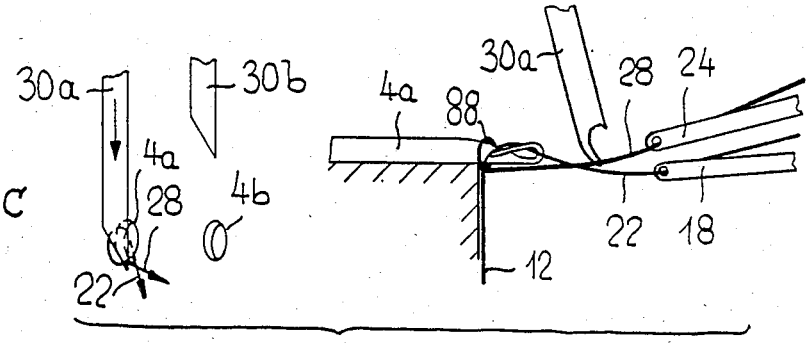
Figure 6D:
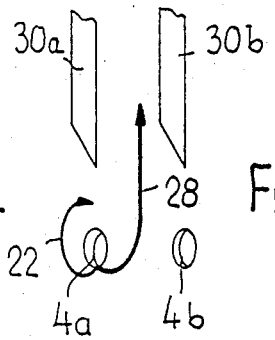
Figure 6E:
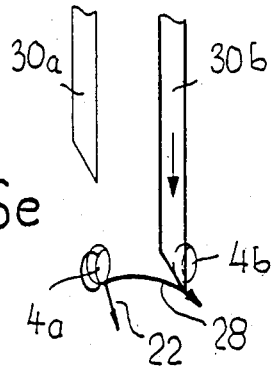

In this manner, the overlaying movements of the pattern thread guide 24 in comparison to the movement of the warp thread guide 18 are prevented, as is clearly shown in FIG. 6*c*. During the withdrawal of the knitting needles 4*a* and 4*b*, the thread retainer 30*a* is retained in the lowermost position shown in FIG. 6*c*. Thereafter, the warp thread guide 18 is again brought from below and around the knitting needle 4*a* to the left, and further on to the upper position whereby the pattern thread 28 is inserted into the stitch 88 on the back side of the knitted work. The pattern thread guide 24 is simultaneously moved to the right of the knitting needle 4*b* and into the uppermost position, as is apparent from FIG. 6*b*. In order to prevent the insertion of a pattern thread 28 into the knitting needle 4*b*, the thread retainer 30*b* is dropped below the plane of the knitting needle so that the pattern thread cannot extend into the work region of the needle 4*b* with the further movement of the pattern thread guide 24 around the knitting needle 4*b*, as is apparent in FIG. 6*e*. Since the pattern thread 28 is not snagged or captured by the knitting needle 4*b*, the pattern thread 28 is not bound into the warp stitch row which is formed by the knitting needle 4*b*. With the return of the pattern thread guide 24, the pattern thread 28 is again pulled and guided to the warp stitch row which is formed by the knitting needle 4*a* as is indicated in the unpatterned section 80 of the warp stitch row $74_4$ of FIG. 4.

At the edges of the patterned region 79 both of the types of knitting in FIGS. 5*a*–5*f*, as well as 6*a* to 6*e*, are combined with one another whereby then the insertion of the pattern thread 28 into the knitting needle 4*a* is possible, as is shown in FIGS. 5*a*–5*d*. Insertion of the pattern thread into the knitting needle 4*b* can be prevented when the knitting machine or correspondingly the pattern control device is controlled in the manner of FIGS. 6*d* and 6*e*, that is, the thread retainer 30*b* is lowered so that the insertion of the pattern thread 28 into the knitting needle 4*b* is prevented. As a result then, the course of the thread is as shown for the warp loop row $74_7$ in the section 92. Similarly, the insertion of the pattern thread 28 into the knitting needle 4*a* can also be prevented and the insertion into the knitting needle 4*b* can be effected. As a result, a stitch pattern can be made, as is illustrated in the section 94 for the warp stitch rows $74_2$ and $74_3$.

Numerous modifications of the disclosed embodiment are possible. For example, the pattern thread for each knitting process can also be inserted over three or more knitting needles one after the other. It is also possible to guide the pattern thread for each knitting process simultaneously over two or more knitting needles and to insert the thread into the warp stitch rows in the patterned regions. In particular, features of individual embodiments can also be interchanged for one another or used in combination.

| List of Reference Numerals | |
|---|---|
| 2 | Knitting needle bar |
| 4 | Knitting needle |
| 6 | Take up cam |
| 8 | Guide plate |
| 10 | Guide column |
| 12 | Knitting work |
| 14 | Take up roll |
| 16 | Pressure roll |
| 18 | Warp thread guide |
| 20 | Warp thread guide bar |
| 22 | Warp thread |
| 24 | Pattern thread guide |
| 26 | Pattern thread guide bar |
| 28 | Pattern thread |
| 30 | Thread retainer |
| 32 | Clamping member |
| 34 | Guide bar |
| 36 | Guide |
| 38 | Pattern control device |
| 40 | Guide bar |
| 42 | Drawing device |
| 44 | Control box |
| 46 | Suspension spring |
| 48 | Weft thread guide forward |
| 50 | Weft thread guide rear |
| 52 | Thread guide |
| 54 | Pattern control device |
| 56 | Thread retainer |
| 58 | Guide bar |
| 60 | Suspension spring |
| 62 | Retainer |
| 64 | Bolt |
| 66 | Rocker arm |
| 68 | Machine frame |
| 70 | Axis |
| 72 | Harness string |
| 73 | Control device |
| 74 | Warp stitch rows |
| $76^{1-8}$ | Weft thread |
| 78 | Elastic thread |
| 79 | Patterned region |
| 80 | Unpatterned section |
| 82 | Patterned section |
| 84 | Open stitch |
| 86 | Closed stitch |
| 88 | Stitch |
| 90 | Front side |
| 92 | Section |
| 94 | Section |

I claim:

1. A method for manufacturing a patterned warp knitted material in which at least one weft thread is inserted into the stitches of the warp stitch rows during the formation of the warp stitch rows from warp threads, and in which further a pattern thread is brought into the warp stitch rows to be patterned, the pattern thread being knitted into the stitches of the warp stitch rows on top of a section which is intended to carry a pattern and is inserted into the stitches of the warp stitch rows at the sections which are not intended to carry a pattern, characterized by feeding the pattern threads (28) in the same manner as the warp threads (22), and guiding the warp threads over at least two knitting needles (4,4*a*,4*b*) and preventing insertion of the pattern threads (28) into the knitting needles (4,4*a*,4*b*) at the sections (80) of the warp stitch rows ($74_2$ to $74_7$) which are not to carry a pattern by means of controlled thread retainers (30,30*a*,30*b*,56).

2. A method according to claim 1 characterized in that the pattern threads (28) for each knitting process are guided alternately over one of at least two knitting needles (4,4*a*,4*b*).

3. A method according to claim 1 characterized in that the warp threads (22) and the pattern threads (28) are fed continuously over the knitting needles from the same side, particularly with the use of tongueless knitting needles (4,4*a*,4*b*).

4. A method according to claim 1 characterized in that the thread retainers (30,30*a*,30*b*,56) are located in front of the projecting ends of the knitting needles, and are held in an upper position above the plane of the knitting needles for insertion of the pattern threads (28) into the knitting needles (4,4*a*,4*b*) and are shifted to a lower position below the plane of the knitting needles to prevent insertion.

5. A method according to claim 1 characterized in that the thread retainers (30,30*a*,30*b*,56) are controlled by means of an electronic pattern control device (38,54).

6. A knitting machine for manufacturing a patterned warp knitted material in which a weft thread is inserted into the stitches of the warp stitch rows and a pattern thread is placed on top of the warp stitch rows which are to carry a pattern, the machine having knitting needles and associated warp thread guides and weft thread guides, pattern thread guides and associated pattern control devices, characterized in that the pattern thread guides (24) are positioned in adjacent relationship with the warp thread guides (18), are operated from a position laterally of the guides and needles above at least two knitting needles (4,4*a*,4*b*) and are movable back and forth between an upper position above the plane of the knitting needles and a lower position below the plane of the knitting needles, and thread retainers (30,30*a*,30*b*,56) for the pattern threads (28), each individually controllable, are positioned such that the insertion of the pattern threads (28) into the knitting needles (4,4*a*,4*b*) is possible in the upper position above the plane of the needles and is prevented in the lower position.

7. A knitting machine according to claim 6 characterized in that the pattern thread guide (24) for each process is operated from a lateral position stepwise above one of at least two knitting needles (4,4*a*,4*b*).

8. A knitting machine according to claim 6 characterized in that the pattern thread guides (24) are needles with eyelets mounted on a common pattern thread guide bar (26).

9. A knitting machine according to claim 6 characterized in that the pattern thread guides (24) and the warp thread guides (18) are mounted on guide bars and are always moved by the bars around the knitting needles (4,4*a*,4*b*) from the same side.

10. A knitting machine according to claim 6 characterized in that the knitting needles (4,4*a*,4*b*) are formed as tongueless needles, preferably crocheting needles.

11. A knitting machine according to claim 6 characterized in that the thread retainers (30,30*a*,30*b*,56) in the lower position extend to a position below the plane of the knitting needles.

12. A knitting machine according to claim 6 characterized in that the thread retainers (30,30*a*,30*b*,56) are inclined at an angle to the pattern thread guides (24).

13. A knitting machine according to claim 6 characterized in that the thread retainers (30,30*a*,30*b*,56) are located in the region between the knitting needles (4,4*a*,4*b*) and the pattern thread guides (24).

14. A knitting machine according to claim 6 characterized in that the thread retainers (30) are movable laterally of the needles.

15. A knitting machine according to claim 6 characterized in that the thread retainers (30,30*a*,30*b*,56) are coupled with a pattern control device (38,54).

16. A knitting machine according to claim 6 characterized in that the thread retainers (30,30*a*,30*b*) are mounted in groups on a guide bar (34) that moves up and down.

17. A knitting machine according to claim 6 characterized in that the thread guides (56) are individually controllable and are preferably connected to a pattern control device (54) by means of a harness string (72).

* * * * *